US007193622B2

(12) United States Patent
Sklovsky et al.

(10) Patent No.: US 7,193,622 B2
(45) Date of Patent: Mar. 20, 2007

(54) METHOD AND APPARATUS FOR DYNAMICALLY CHANGING PIXEL DEPTH

(75) Inventors: Valdimir Sklovsky, Vernon Hills, IL (US); Robert J. Bero, Spring Grove, IL (US)

(73) Assignee: Motorola, Inc., Schaumburg, IL (US)

( * ) Notice: Subject to any disclaimer, the term of this patent is extended or adjusted under 35 U.S.C. 154(b) by 118 days.

(21) Appl. No.: 10/719,342

(22) Filed: Nov. 21, 2003

(65) Prior Publication Data

US 2005/0110783 A1 May 26, 2005

(51) Int. Cl.
*G09G 5/00* (2006.01)

(52) U.S. Cl. ..... 345/204; 345/77

(58) Field of Classification Search ..... 345/605, 345/613, 611, 572, 520, 155, 104, 77–100, 345/102, 600, 614, 626, 42, 63, 72, 204, 345/690, 698, 156, 169; 340/703, 799
See application file for complete search history.

(56) References Cited

U.S. PATENT DOCUMENTS 4,943,801 A * 7/1990 Oguchi ..... 345/563
4,979,136 A * 12/1990 Weiman et al. ..... 382/169
5,122,784 A * 6/1992 Canova ..... 345/605
5,251,298 A * 10/1993 Nally ..... 345/568
5,838,310 A * 11/1998 Uya ..... 345/536
5,936,617 A * 8/1999 Uchino et al. ..... 345/204
5,959,637 A 9/1999 Mills et al.
6,046,725 A * 4/2000 Yoon ..... 345/605
6,057,838 A * 5/2000 Kuwajima et al. ..... 715/807
6,476,800 B2 * 11/2002 Millman et al. ..... 345/212
6,683,617 B1 * 1/2004 Naoi et al. ..... 345/613
6,734,868 B2 * 5/2004 Gornstein et al. ..... 345/572
6,778,187 B1 * 8/2004 Yi ..... 345/605
6,819,320 B2 * 11/2004 Lavelle et al. ..... 345/501
2003/0043096 A1 * 3/2003 Heie ..... 345/87
2003/0222839 A1 * 12/2003 Lee ..... 345/88
2004/0263461 A1 * 12/2004 Park ..... 345/98
2006/0050079 A1 * 3/2006 Ben-Chorin et al. ..... 345/590

FOREIGN PATENT DOCUMENTS

JP 2001286348 S 7/2001
JP 2002237886 A 8/2002
WO WO95/30220 11/1995
WO WO99/53472 4/1998
WO WO01195596 12/2001

* cited by examiner

*Primary Examiner*—Nitin Patel
(74) *Attorney, Agent, or Firm*—Charles W. Bethards; Lawrence J. Chapa

(57) ABSTRACT

An electronic device (108) includes a display panel (126) and a display controller (124) for controlling the display panel (126). A plurality of data lines supplies image data to the display panel (126). The data lines include data lines for supplying red image data, green image data, and blue image data. Masking gates (118) are provided between a video buffer (116) and the display controller (124). A method of reducing power consumption includes masking selected ones of the data lines at predetermined times. The masking reduces the pixel depth of the image data. Thus, the pixel depth is reduced without re-encoding the source video data. Reducing the number of state transitions in the video data path reduces power consumption, thus longer battery life.

22 Claims, 4 Drawing Sheets

| COLOR | | BLUE | | | | | | | | GREEN | | | | | | | | RED | | | | | | | |
|---|---|---|---|---|---|---|---|---|---|---|---|---|---|---|---|---|---|---|---|---|---|---|---|---|---|
| LINE | | 7 | 6 | 5 | 4 | 3 | 2 | 1 | 0 | 7 | 6 | 5 | 4 | 3 | 2 | 1 | 0 | 7 | 6 | 5 | 4 | 3 | 2 | 1 | 0 |
| GATED AND LOGIC | OUTPUT STATUS | 0 | 0 | 0 | 0 | 0 | X | X | X | 0 | 0 | 0 | 0 | 0 | 0 | X | X | 0 | 0 | 0 | 0 | 0 | X | X | X |
| | MASK REGISTER | 0 | 0 | 0 | 0 | 0 | 1 | 1 | 1 | 0 | 0 | 0 | 0 | 0 | 0 | 1 | 1 | 0 | 0 | 0 | 0 | 0 | 1 | 1 | 1 |
| GATED NAND LOGIC | OUTPUT STATUS | 1 | 1 | 1 | 1 | 1 | X | X | X | 1 | 1 | 1 | 1 | 1 | 1 | X | X | 1 | 1 | 1 | 1 | 1 | X | X | X |
| | MASK REGISTER | 1 | 1 | 1 | 1 | 1 | 0 | 0 | 0 | 1 | 1 | 1 | 1 | 1 | 1 | 0 | 0 | 1 | 1 | 1 | 1 | 1 | 0 | 0 | 0 |

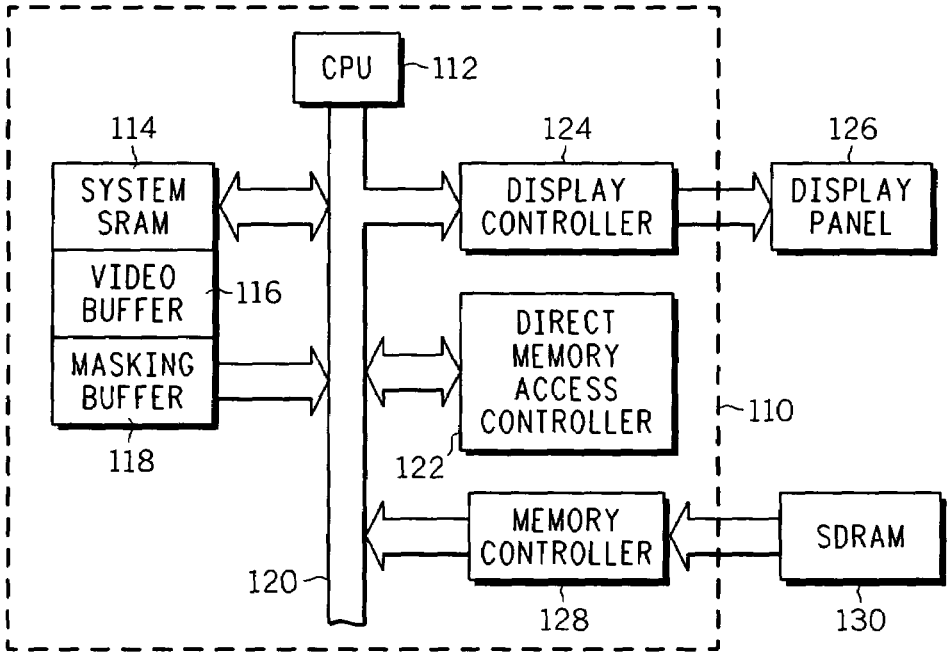
FIG. 1 108
FIG. 2
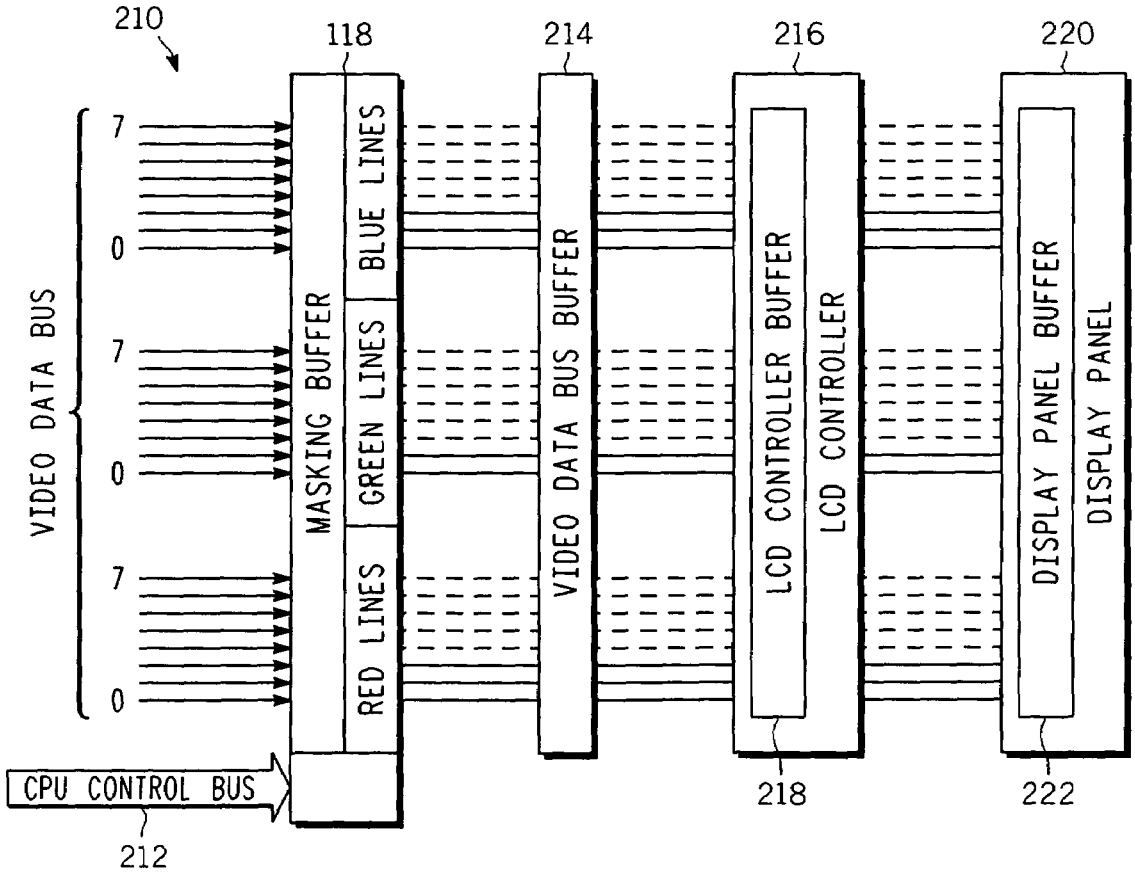

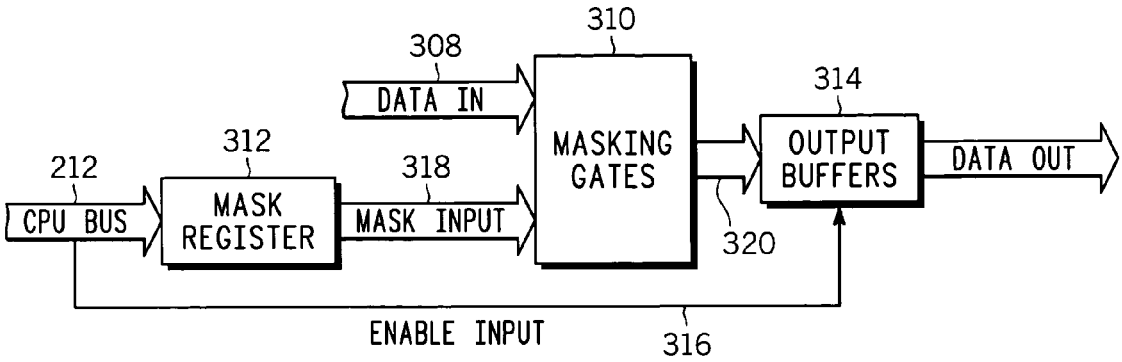
FIG. 3 118
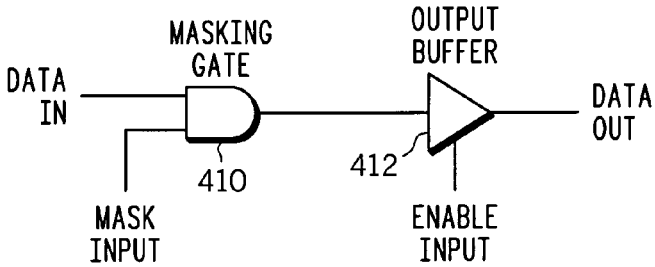
FIG. 4
FIG. 5
| COLOR | | BLUE | | | | | | | | GREEN | | | | | | | | RED | | | | | | | |
|---|---|---|---|---|---|---|---|---|---|---|---|---|---|---|---|---|---|---|---|---|---|---|---|---|---|
| LINE | | 7 | 6 | 5 | 4 | 3 | 2 | 1 | 0 | 7 | 6 | 5 | 4 | 3 | 2 | 1 | 0 | 7 | 6 | 5 | 4 | 3 | 2 | 1 | 0 |
| GATED AND LOGIC | OUTPUT STATUS | 0 | 0 | 0 | 0 | 0 | X | X | X | 0 | 0 | 0 | 0 | 0 | 0 | X | X | 0 | 0 | 0 | 0 | 0 | X | X | X |
| | MASK REGISTER | 0 | 0 | 0 | 0 | 0 | 1 | 1 | 1 | 0 | 0 | 0 | 0 | 0 | 0 | 1 | 1 | 0 | 0 | 0 | 0 | 0 | 1 | 1 | 1 |
| GATED NAND LOGIC | OUTPUT STATUS | 1 | 1 | 1 | 1 | 1 | X | X | X | 1 | 1 | 1 | 1 | 1 | 1 | X | X | 1 | 1 | 1 | 1 | 1 | X | X | X |
| | MASK REGISTER | 1 | 1 | 1 | 1 | 1 | 0 | 0 | 0 | 1 | 1 | 1 | 1 | 1 | 1 | 0 | 0 | 1 | 1 | 1 | 1 | 1 | 0 | 0 | 0 |

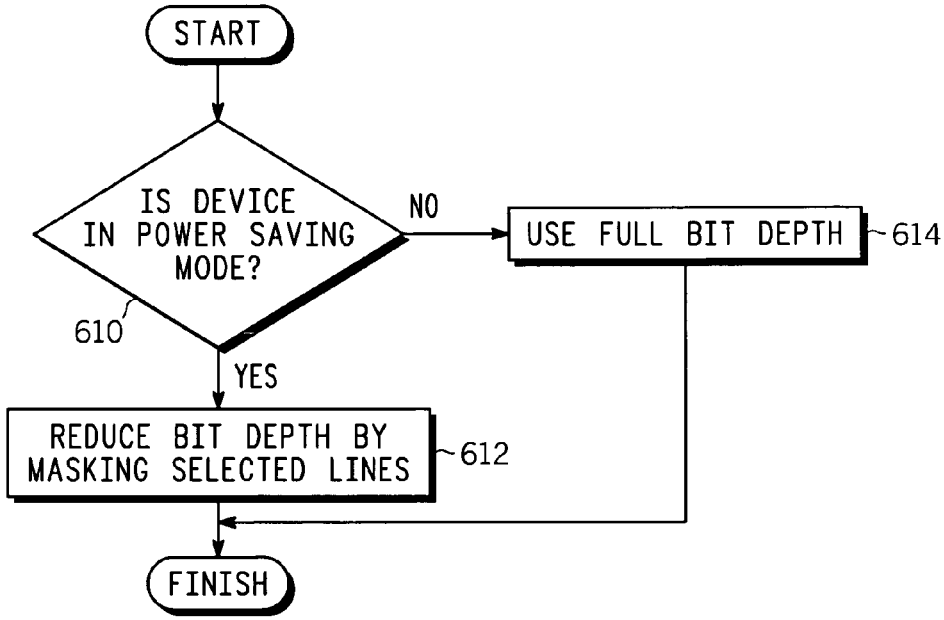
*FIG. 6*
*FIG. 7*
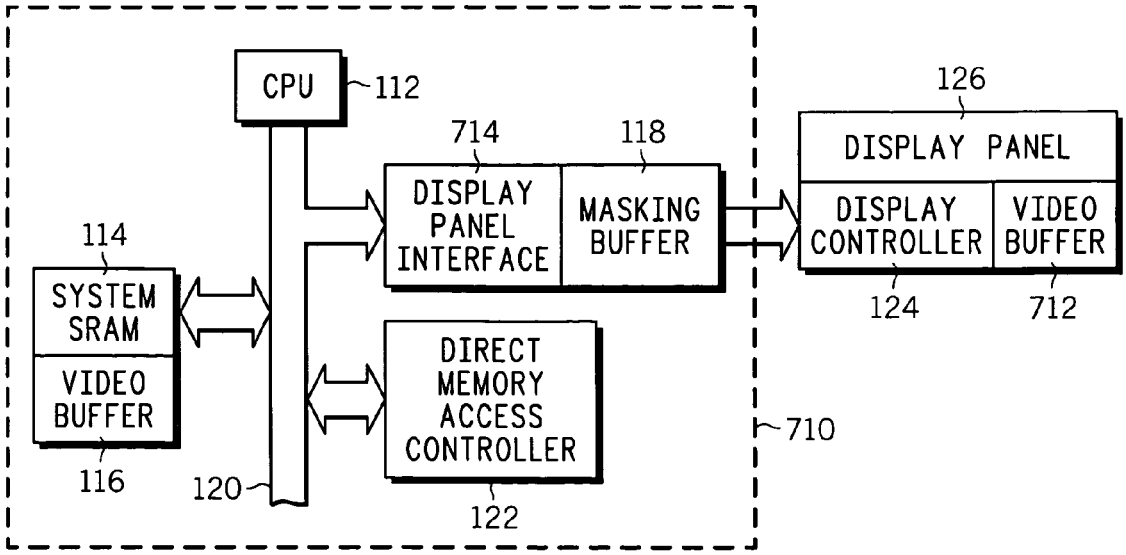

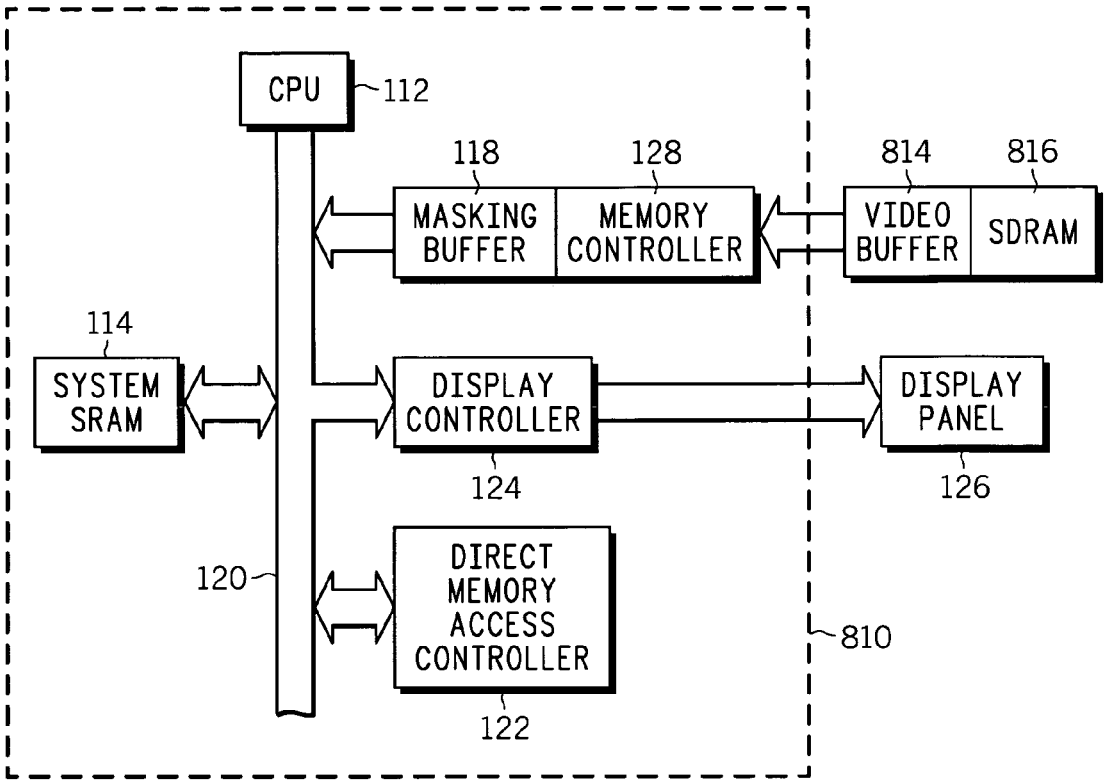
FIG. 8 808
908 FIG. 9
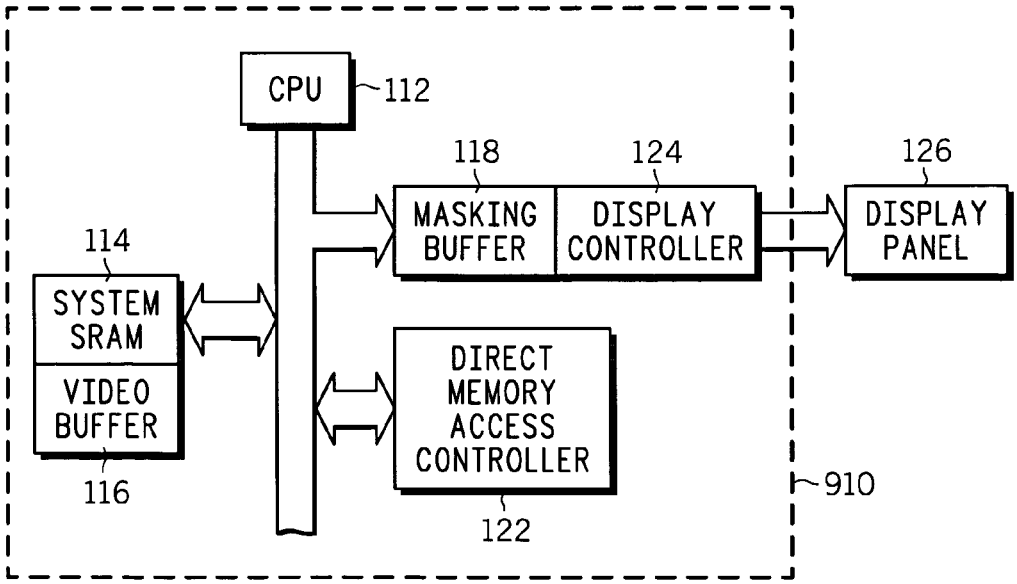

METHOD AND APPARATUS FOR DYNAMICALLY CHANGING PIXEL DEPTH

FIELD OF THE INVENTION

This invention relates in general to color displays for electronic devices, and more particularly, to a mobile electronic device in which the pixel depth of color image data can be changed dynamically.

BACKGROUND OF THE INVENTION

Battery life is an important issue in, portable electronic devices. Mobile telephones, for example, often have power saving modes, such as a discontinuous receive mode, or DRX mode, to extend battery life. In the DRX mode, mobile telephones can have stringent power consumption objectives. In one example, the total power consumption in the DRX mode is expected to be below 10 milli-watts (mW) and targeted at a 2.5 mW level. Thus practitioners are driven to look at all power consuming functions included with the phones. One such device is the display and associated display processing circuits and drivers. Displays have become larger and more recently many displays are color displays, both factors increasing power consumption associated with the display. At the power consumption levels noted above, in many instances, only a simple, low quality, static image can be displayed. Also, there are power-saving conditions of a mobile telephone in which keeping video information alive has a higher priority than the quality of the displayed image.

One parameter that affects the amount of power consumed in displaying images is bits per pixel, or BPP. This parameter is also known as pixel depth. As the pixel depth increases, more bytes of video information have to be processed and transmitted through busses from memory to the display controller and to the display panel. Data shows that approximately 2.2 mW of power can be spent to move 16 bit QVGA format (parallel LCD interface) data from a video Static Random Access Memory (SRAM) buffer to a Liquid Crystal Display (LCD) controller and then to a corresponding display panel. Reducing the pixel depth to eight bits almost halves the power consumption (from 2.2 mW to 1.1 mW). A reduction of the pixel depth from twenty-four bits to eight or four bits provides even more power reduction.

LCD controllers typically have programmable pixel depth values. That is, a typical LCD controller has a palette RAM that can increase the pixel depth to improve the image quality, but the opposite is not true. That is, a typical LCD controller cannot reduce the pixel depth. To reduce the pixel depth, all video images must be re-encoded with CPU processing, which may require more energy than that saved by the reduction in pixel depth. That is, to change pixel depth from a higher level, such as sixteen, twenty or twenty-four BPP, to a lower value, such as four or eight BPP, all video images and primitives, which are already mapped for higher pixel depth into video memory and stored in part of the system memory, must be re-encoded. The energy cost of doing so may exceed the energy savings realized by lowering the pixel depth.

BRIEF DESCRIPTION OF THE DRAWINGS

The accompanying figures where like reference numerals refer to identical or functionally similar elements throughout the separate views and which together with the detailed description below are incorporated in and form part of the specification, serve to further illustrate various embodiments and to explain various principles and advantages in accordance with the present invention.

FIG. 1 is an exemplary block diagram showing selected parts of an electronic device;

FIG. 2 is an exemplary diagram illustrating a 24 bit video data bus that is masked;

FIG. 3 is an exemplary block diagram of a masking buffer;

FIG. 4 is an exemplary block diagram of a single-line masking buffer, or masking gate;

FIG. 5 is a table illustrating the output status and the register status of the masking buffer of FIG. 3;

FIG. 6 is an exemplary flow chart illustrating a method of reducing bit depth in an electronic device;

FIG. 7 is an exemplary block diagram showing selected parts of an electronic device in another embodiment;

FIG. 8 is an exemplary block diagram showing selected parts of an electronic device in a further embodiment; and FIG. 9 is an exemplary block diagram showing selected parts of an electronic device in a further embodiment of the present invention.

DETAILED DESCRIPTION OF PREFERRED EMBODIMENTS

The present disclosure concerns portable electronic devices having displays. The electronic devices may be, for example, wireless communications devices or units, often referred to as subscriber devices, such as cellular handsets or phones.

More particularly various inventive concepts and principles embodied in methods and apparatus for dynamically changing pixel depth for a display are discussed. The electronic device can be any of a variety of portable devices including, for example wireless communication units, such as cellular handsets, messaging devices, personal digital assistants, and the like or equivalents thereof.

The electronic devices that are of particular interest are those that provide or facilitate voice communication services or data or messaging services, such as those used in conjunction with conventional two way systems and devices, various cellular phone systems including analog and digital cellular, CDMA (code division multiple access) and variants thereof, GSM, GPRS (General Packet Radio System), 2.5 G and 3 G systems such as UMTS (Universal Mobile Telecommunication Service) systems, integrated digital enhanced networks, local area networks and variants or evolutions thereof.

As further discussed below various inventive principles and combinations thereof are advantageously employed to provide a method and apparatus for dynamically changing pixel depth, thus alleviating various problems, such as power consumption or battery life associated with known electronic devices provided these principles or equivalents thereof are employed.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, upper and lower and the like are used solely to distinguish one from another entity or action without necessarily requiring or implying any actual such relationship or order between such entities or actions.

The terms "a" or "an" as used herein are defined as one or more than one. The term "plurality" as used herein is defined as two or more than two. The term "another" as used herein is defined as at least a second or more. The terms "including," "having" and "has" as used herein are defined as comprising (i.e., open language). The term "coupled" as used herein is defined as connected, although not necessarily directly and not necessarily mechanically.

Much of the inventive functionality and many of the inventive principles are best implemented with or in software programs or instructions and integrated circuits (ICs) such as application specific ICs. It is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. Therefore, in the interest of brevity and minimization of any risk of obscuring the principles and concepts according to the present invention, further discussion of such software and ICs, if any, will be limited to the essentials with respect to the principles and concepts used by the preferred embodiments.

FIG. 1 is an exemplary embodiment of an electronic device 108, which is, for example, a mobile telephone. FIG. 1 shows only selected components for simplicity. Known elements of the mobile phone, such as the transceiver, the antenna, the user interface, the battery, and other components are not illustrated. The electronic device 108 includes a central processing unit (CPU) 112 and a system bus 120. Coupled to the system bus 120 are system SRAM 114, a video buffer 116, and a masking buffer 118. In this example, the video buffer 116 is the source of video objects and primitives for the display controller 124. Also coupled to the system bus 120 are a memory controller 128, which is coupled to an SDRAM 130, and a direct memory access controller 122. Further, a display controller 124 is coupled to the system bus 120, and a display panel 126 is downstream of and coupled to the display controller 124. Thus, the masking gates 118 are coupled to the input of the display controller 124. The masking gates 118, which are described in detail below, need not be directly coupled to the display controller 124 and may be indirectly coupled to the display controller 124, as will be recognized by those skilled in the art. The display panel 126 is, for example, an LCD display. In this example, all the illustrated components, except for the display panel 126, can be advantageously formed on a large scale integrated circuit 110.

The direct memory access controller 122 provides control of continuously moving video data from the video buffer 116 for refreshing the display panel 126 without control by the CPU 112. The CPU 112 provides new image processing to the video buffer 116. However, during system standby modes, or power saving modes, such as a discontinuous receive, or DRX, mode, when there is a need to maintain a static image, the only image data flow is video data flow from the video buffer 116 to the display panel 126 under the control of the direct memory access controller 122, which results in a substantial power savings.

The masking buffer 118 serves to dynamically and selectively mask image data bits to reduce the pixel depth of the image data sent to the display panel 126. The masking prevents masked bits, or data lines, from changing state. The resulting video image is still based on the same video primitives and objects that are used for regular, full pixel depth presentation. The masked lines have a predetermined, consistent logic output level. The color palette of the display depends on which bits are masked.

It is well known that the power consumption of most common types of digital circuits depends on the number of state transitions. Since the masked lines do not change state, power savings result, and the power savings is proportional to the degree of masking. The masking requires no image re-encoding by the CPU 112; therefore, the power savings realized by reducing the pixel depth is not offset by additional power consumed by additional CPU processing.

Masking selected bits can reduce the quality of the image displayed by the display panel 126. Therefore, image quality may be sacrificed for extended battery life. However, in at least one embodiment of the invention, masking only takes place during a power saving mode of the electronic device 108. The pixel depth is normal, or full, at other times. In addition, there are times when reduced image quality is acceptable, such as when text or simple icons are being displayed. Therefore, the masking can be enabled, or put into effect, at chosen or appropriate times so as to minimize disturbances or inconvenience to the user.

FIG. 2 diagrammatically illustrates a video data flow path in a device such as the electronic device 108 of FIG. 1. The flow of data in FIG. 2 is left to right. At the left side of FIG. 2 is a video data bus 210. All twenty-four of the data lines are actively changing logic states or changing value between two or more states or values, i.e. toggling, in the video data bus 210. That is, all twenty-four of the data lines are actively changing value according to the image data being transmitted in the video data path. Thus, in this example, the video data bus 210 carries 24 bit color image data. The video data bus 210 delivers video data to the masking buffer 118. In this example, the masking buffer masks a predetermined number of the bits or data lines associated with each of the red image data, the green image data, and the blue image data, as shown. The bits or data lines that are masked will depend on various factors such as palette structure and the particular display controller and display panel interface and architecture, however in general those lines carrying or representing data for finer or smaller adjustments to the respective red, green, or blue image data are typically masked. This can be advantageous since these least significant bits represent smaller or more modest changes in or to the display quality. Furthermore these least significant bits are more likely to change states with greater frequency and thus contribute greater to power consumption.

To the right of the masking buffer 118 are broken and solid parallel lines. The solid lines to the right of the masking buffer 118 represent active, toggled or state changing data lines, the states of which are unaffected by the masking buffer 118. That is, the solid lines represent lines that are allowed to change value according to image data being sent to the display panel 126. The broken lines to the right of the masking buffer 118 represent inactive, or masked, data lines, which hold a predetermined, permanent logic state.

Downstream of and coupled to outputs of the masking buffer 118 is a video data bus buffer 214, as shown. There may be multiple video data bus buffers, depending on the internal IC bus architecture.

Downstream and coupled to outputs of the video data bus buffer 214 is an LCD controller 216, which corresponds to the display controller 124 of FIG. 1. The LCD controller includes an LCD controller buffer 218, as shown. Downstream and coupled to outputs of the LCD controller 216 is the display panel 220, which includes a display panel buffer 222, as shown.

Since power savings occur only downstream of the masking buffer, it is most efficient to place the masking buffer as far upstream in the video data flow path as possible. In other words, the masking buffer 118 should be placed as close to the source of the image data as possible. For example, FIG. 1 shows the masking buffer 118 located at the output side of the video buffer 116. That is, the output of the video buffer 116 is coupled to an input of one or more of the masking gates 118. However, the masking buffer 118 can be placed in several locations along the video data flow path, as those skilled in the art will recognize.

The masking buffer 118 is controlled by the CPU control bus 212, as indicated in FIG. 2. That is, the CPU determines whether or not masking takes place. If masking takes place, the CPU determines which data lines are masked. The masking and the selecting of data lines to mask can change dynamically depending on predetermined conditions. Software stored in a memory (not shown) of the electronic device 108 and executed by the CPU 112 determines when masking takes place. That is, certain criteria monitored by the CPU 112 can trigger masking and the disablement of masking. Thus, the masking is dynamically put into effect and disabled according to a balance between power saving needs and the demand for quality images. Further, such software can dynamically change which of the many data lines are masked and which are allowed to toggle or change states.

FIG. 3 illustrates an exemplary structure of the masking buffer 118. Input data at 308 corresponds to the video data bus 210 of FIG. 2. Masking gates 310 serve to mask selected ones of the input data lines at predetermined times to adjust the pixel depth of the image data. A mask register 312 or contents thereof, which is controlled via the CPU bus 212, defines which data lines are masked. A mask input 318 from the mask register 312 serves as one input to the masking gates 310. The mask gates 310 employ known logic gates to hold the state of the masked lines at a predetermined logic state and to permit the unmasked lines to change value or toggle according to image information in the input flow of data 308. When masking is disabled, the masking gates 310 have no effect on the data lines.

Output data at 320 is input to output buffers 314. In this example, the output buffers 314 are tri-state buffers, which require an enable input 316. As long as the output buffers 314 are enabled, they have no effect on the logic states of the data lines. The output buffers 314 are not essential but may be useful, depending on the system architecture, according to well known IC design principles. Disabling the output buffers 314 stops the output of image data from the output buffers in a known manner.

FIG. 4 shows a masking gate 410 corresponding to a single data line of the structure of FIG. 3 and of the diagram of FIG. 2. Assuming the input flow of data 308 in FIG. 3 is twenty-four bit data, the structure of FIG. 4 is duplicated twenty four times in the structure of FIG. 3. In this example, the masking gate 410 is an AND gate; however, as discussed below, a NAND gate may be used to accomplish the same goal. One input of the masking gate 410 is one of the image data lines. The other input to the mask gate 310 is a mask input from the mask register 312. Thus, the content of the mask register 312 determines whether masking occurs and which lines are masked. In other words, the CPU 112 is coupled to the masking gates 118, and the CPU 112 provides one or more control signals to an input of each of the masking gates.

An output buffer 412 is located downstream of the masking gate 410, as shown. As mentioned above, the output buffer 412 is a tri-state buffer that is always enabled when image data is to be sent to the display panel 126, regardless of whether masking is taking place. The output buffer 412 may be eliminated in certain embodiments.

FIG. 5 is a table illustrating output bit status and mask register content for twenty-four bit image data in the masking buffer of FIG. 3. The X symbols represent bits that are allowed to change states, toggle, or change value, according to image data of the input data flow 308. The table illustrates a state where all but eight of twenty-four data lines are masked. In this example, the three blue lines, designated lines 0–2, are allowed to toggle, the two green lines, designated 0–1, are allowed to toggle, and the three red lines, designated 0–2, are allowed to toggle. As noted above these lines that are not masked typically correspond to the most significant image data or bits for each of the colors, while the masked lines correspond to the least significant image data. If masking were disabled, all the bits in the output status rows would be represented by X symbols, since all bits would be allowed to toggle.

Two of the rows are designated "gated AND logic." These rows show the content of the mask register 312 and the output of the masking gates 310 during masking. As illustrated, ones are placed in bits of the mask register 312 that correspond to data lines that are permitted to toggle. Zeros are placed in bits of the mask register that correspond to data lines that are masked. Since the content of the mask register 312 is dynamically and programmatically determined by the CPU 112, the masking can be dynamically and programmatically changed.

Two of the rows are designated "gated NAND logic." These rows show the content of the mask register 312 and the output of the masking gates 310 during masking if a NAND gate were substituted for the AND gate that is employed as the masking gate 410 in FIG. 4. As illustrated, zeros are placed in bits of the mask register 312 that correspond to data lines that are permitted to toggle. Ones are placed in bits of the mask register that correspond to data lines that are masked. Again, since the content of the mask register 312 is dynamically and programmatically determined by the CPU 112, the masking can be dynamically and programmatically changed.

FIG. 6 is a flow chart illustrating an exemplary routine that may be used to determine when masking is enabled. The routine of FIG. 6 is stored in memory and executed periodically by the CPU 112. In a decision 610, the CPU 112 determines whether the electronic device 108 is in a power saving mode. When the electronic device 108 is a mobile phone, for example, the decision 610 may determine whether the mobile phone is in a discontinuous receive mode, or DRX mode, for extending battery life. Thus, for example, a flag stored in memory can indicate whether the electronic device 108 is in the discontinuous receive mode, and the decision 610 determines the state of the flag.

If the outcome of the decision 610 is positive, a masking operation 612 is performed. Thus, the masking register 312 is filled, for example, according to the table of FIG. 5 to perform masking. If the outcome of the decision 610 is negative, masking is disabled so that the full pixel depth is available. The masking register 312 is filled with ones to disable masking, assuming AND gate logic is being employed, as in FIG. 4. There are other choices for criteria that determine whether and when masking is performed. For example, masking may be performed when text is being displayed, since text does not require a great pixel depth. Further, the method can employ criteria to determine the resulting pixel depth after masking. In the illustrated example, the pixel depth is reduced from 24 bit color to 8 bit color. However, the data lines can be masked such that the 24 bit color is reduced to 16 bit color if an intermediate image quality is desired. That is, the number of lines selected for masking can be varied to alter the power consumption of the display circuitry. The possible variations and combinations of masking levels and masking times are endless. Since the level and time of masking is determined by the contents of the mask register 312, it is a relatively simple matter to programmatically change the level and time of masking.

In the example shown in FIG. 1, the masking buffer 118 is located at the output side of a video buffer 116. However, there are many other locations at which the masking buffer 116 can be located. In the example of FIG. 7, an electronic device 708 includes many of the same parts shown in FIG. 1. The electronic device of FIG. 7, like the electronic device of FIG. 1, may be a wireless communication device such as a mobile telephone. In the electronic device 708, the display controller 124 and a video buffer 712 are combined with the display 126 and are external to an integrated circuit 710 on which the other illustrated components are formed. The integrated circuit 710 includes a display panel interface 714, and the masking buffer 118 is located at an output side of the display panel interface 714, as shown. In other words, the display panel interface 714 has an output coupled to an input of one or more of the masking gates 118. In this case, all data flow for refreshing the display panel 126 is located externally and might be optimized locally by the display controller 124. If the masking buffer 118 were located at the input of the display panel interface 714, the masking buffer 118 might reduce the data flow of dynamic video images in power saving modes, when the CPU 112 sends video data to the video buffer 712 to refresh the image.

In the example of FIG. 8, an electronic device 808 includes many of the same parts shown in FIGS. 1 and 7. The electronic device of FIG. 8, like the electronic device 108 of FIG. 1, may be a wireless communication device such as a mobile telephone. In the electronic device 808 of FIG. 8, the source of video data is a standard SDRAM 816, which is external to an integrated circuit 810. A video buffer 814 is part of the SDRAM 816. A memory controller 128 is located on the integrated circuit 810, and the memory controller 128 receives video data from the video buffer 814. The masking buffer 118 is located on the output side of the memory controller 128, as shown. The masking buffer 118 may also be formed internally in the memory controller 128.

In the example of FIG. 9, an electronic device 908 includes many of the same parts shown in FIGS. 1, 7 and 8. The electronic device 908 of FIG. 9, like the electronic device 108 of FIG. 1, may be a wireless communication device such as a mobile telephone. In the electronic device 908 of FIG. 9, the masking buffer 118 is located on the input side of the display controller 124, both of which are formed on an integrated circuit 910. Although several different locations of the masking buffer 118 have been illustrated, there are others as will be apparent to skilled artisans. Furthermore, the components that are shown in FIGS. 1 and 7–9 as being on the same integrated circuit need not be on the same integrated circuit. That is the various components may be on separate, coupled circuits in a known manner.

The apparatus and methods discussed above and the inventive principles thereof are intended to and can alleviate problems with conventional electronic devices such as wireless communication units. Using these principles of masking and battery life extension will contribute to user satisfaction. It is expected that one of ordinary skill given the above described principles, concepts and examples will be able to implement other alternative procedures and constructions that offer the same benefits. It is anticipated that the claims below cover many such other examples. For example, although the illustrated examples show a twenty-four bit video data bus, the video data bus can be any size. Although the illustrated masking results in a pixel depth of 8 bits, other masking levels are possible. For example, the masking may result in a pixel depth of four, sixteen or twenty bits.

The disclosure is intended to explain how to fashion and use various embodiments in accordance with the invention rather than to limit the true, intended and fair scope and spirit thereof. The forgoing description is not intended to be exhaustive or to limit the invention to the precise form disclosed. Modifications or variations are possible in light of the above teachings. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. An electronic device comprising:

a display panel;

a display controller that controls the display panel;

a plurality of data lines that supply image data to the display panel, wherein the data lines include data lines for supplying red image data, data lines for supplying green image data, and data lines for supplying blue image data; and masking gates that mask selected ones of the data lines at predetermined times to adjust the pixel depth of the image data supplied to the display panel.

2. The electronic device according to claim 1, wherein the electronic device includes a processor coupled to the masking gates, and the processor provides one or more control signals to an input of each of the masking gates.

3. The electronic device according to claim 1, wherein the electronic device includes a processor, wherein the processor is coupled to the masking gates, and the processor causes the masking gates to mask the selected ones of the data lines when the electronic device is in a power saving mode.

4. The electronic device according to claim 1, wherein the masking gates are coupled to an input of the display controller.

5. The electronic device according to claim 1, further comprising a display panel interface, wherein an output of the display panel interface is coupled to an input of one or more of the masking gates.

6. The electronic device according to claim 1, further comprising a video buffer, wherein an output of the video buffer is coupled to an input of one or more of the masking gates.

7. The electronic device according to claim 1, wherein the electronic device is a mobile telephone.

8. The electronic device according to claim 1, wherein the masking gates include an AND gate.

9. A method of reducing power consumption of an electronic device, the method comprising:

transmitting image data to the display panel, where the image data is associated with plurality of data lines; and reducing the pixel depth of image data transmitted to a display panel at certain times, wherein reducing the pixel depth of image data includes, masking selected data lines of the plurality of data lines that transmit image data to the display panel.

10. The method according to claim 9, wherein the method comprises masking selected data lines that supply red image data, selected lines that supply green image data, and selected lines that supply blue image data such that the selected data lines maintain a constant level when the electronic device is in a power saving mode.

11. The method according to claim 10, wherein the data lines being masked are a predetermined number of the least significant bits associated with each of the lines supplying red image data, green image data, and blue image data.

12. The method according to claim 9, wherein the method comprises disabling the masking when the electronic device is not in a power saving mode.

13. The method according to claim 9, wherein the masking is such that image data lines that are not masked are allowed to change value according to image data that is sent to the masking gates.

14. The method according to claim 9, wherein the masking of selected data lines includes masking selected data lines coupled to the input of a display controller.

15. The method according to claim 9, wherein the masking is performed on image data in a mobile telephone.

16. The method according to claim 9, wherein masking reduces the pixel depth of the image data, and the method includes producing images based on a full pixel depth, when masking is not being performed, and producing images at a reduced pixel depth, when the masking is being performed, and the method includes using the same image data as a source when producing images based on a full pixel depth and when producing images at a reduced pixel depth.

17. The method according to claim 16 including employing a processor to determine which of a plurality of data lines are the selected lines, wherein the method further includes varying the number of selected lines to vary the power consumption of the electronic device.

18. A method of reducing power consumption of an electronic device by reducing the pixel depth of video data transmitted to a display panel, wherein the method comprises masking selected data lines that supply red image data, selected lines that supply green image data, and selected lines that supply blue image data such that the selected data lines maintain a constant level when the electronic device is in a power saving mode.

19. The method according to claim 18, wherein the method comprises disabling the masking when the electronic device is not in a power saving mode.

20. The method according to claim 18, wherein the method includes permitting data lines that are not masked to change state according to image data being sent to the masking gates.

21. The method according to claim 18, wherein the masking of selected data lines includes masking selected data lines coupled to the input of a display controller.

22. The method according to claim 18, wherein the masking is performed on image data in a mobile telephone.

* * * * *